US007931169B2

(12) United States Patent
Erekson

(10) Patent No.: US 7,931,169 B2
(45) Date of Patent: Apr. 26, 2011

(54) DISPENSER

(76) Inventor: Barbara Erekson, Woodland Hills, CA (US)

( * ) Notice: Subject to any disclaimer, the term of this patent is extended or adjusted under 35 U.S.C. 154(b) by 0 days.

(21) Appl. No.: 12/104,742

(22) Filed: Apr. 17, 2008

(65) Prior Publication Data

US 2008/0190955 A1 Aug. 14, 2008

Related U.S. Application Data

(63) Continuation-in-part of application No. 29/303,832, filed on Feb. 19, 2008, and a continuation-in-part of application No. 11/470,956, filed on Sep. 7, 2006.

(60) Provisional application No. 60/715,218, filed on Sep. 7, 2005, provisional application No. 60/730,588, filed on Oct. 26, 2005.

(51) Int. Cl.
*B65H 1/08* (2006.01)

(52) U.S. Cl. ..... 221/58; 221/45; 221/307; 221/309; 221/56

(58) Field of Classification Search ..... 221/1–312 C
See application file for complete search history.

(56) References Cited

U.S. PATENT DOCUMENTS

| | | | | | |
|---|---|---|---|---|---|
| 381,677 | A | * | 4/1888 | Culver et al. | 221/309 |
| 409,055 | A | * | 8/1889 | Mitchell | 221/281 |
| 546,849 | A | * | 9/1895 | Hughes | 221/45 |
| 1,135,658 | A | * | 4/1915 | Brown et al. | 221/45 |
| 1,223,946 | A | * | 4/1917 | Fenigstein | 206/37 |
| 1,296,123 | A | * | 3/1919 | Saha | 221/154 |
| 2,008,016 | A | * | 7/1935 | Hamilton | 206/125 |
| 2,619,398 | A | * | 11/1952 | Kenmotsu | 221/59 |
| 2,638,211 | A | * | 5/1953 | Spurr | 206/449 |
| 2,696,325 | A | * | 12/1954 | Beier | 221/55 |
| 3,186,626 | A | | 6/1965 | Shvetz | |
| 3,269,592 | A | * | 8/1966 | Slye et al. | 221/44 |
| 3,341,067 | A | * | 9/1967 | Bastian | 221/44 |
| 3,450,308 | A | * | 6/1969 | Schoenefeld | 221/305 |
| 3,610,510 | A | | 10/1971 | Lowry | |
| 3,724,716 | A | * | 4/1973 | Baraconi et al. | 221/47 |
| D239,596 | S | | 4/1976 | Dogliotti | |
| D252,161 | S | | 6/1979 | Flower | |
| 4,222,621 | A | * | 9/1980 | Greenlee et al. | 242/560.3 |
| D259,153 | S | | 5/1981 | Valente | |
| 4,382,526 | A | * | 5/1983 | Stone | 221/34 |
| 4,585,145 | A | * | 4/1986 | Pitroda | 221/58 |

(Continued)

FOREIGN PATENT DOCUMENTS

EP 0 688 822 A2 12/1995

OTHER PUBLICATIONS

International Search Report for PCT/US06/35160 Dated Jan. 10, 2008.

(Continued)

*Primary Examiner* — Gene Crawford
*Assistant Examiner* — Michael K Collins
(74) *Attorney, Agent, or Firm* — Michael Blaine Brooks, P.C.; Michael B. Brooks

(57) ABSTRACT

A dispenser having a first member rotatably engaging a second member to form a cavity from which sheets such as flat bags may be dispensed via a lineal aperture and a sheet-guiding member extending from the first member into the cavity.

4 Claims, 18 Drawing Sheets

U.S. PATENT DOCUMENTS

| | | | | | |
|---|---|---|---|---|---|
| 4,646,937 | A | * | 3/1987 | Doshi | 221/56 |
| 4,677,684 | A | | 6/1987 | Gatward | |
| D291,612 | S | | 8/1987 | Inui | |
| 4,974,783 | A | | 12/1990 | Campbell | |
| 4,984,530 | A | * | 1/1991 | Dutton | 118/43 |
| 5,042,687 | A | * | 8/1991 | McKinley | 221/311 |
| 5,335,811 | A | * | 8/1994 | Morand | 221/45 |
| 5,511,691 | A | * | 4/1996 | West, Jr. | 221/311 |
| 5,526,973 | A | * | 6/1996 | Boone et al. | 225/34 |
| D375,456 | S | | 11/1996 | Borgmann | |
| 5,642,836 | A | * | 7/1997 | Merriweather, Jr. | 221/62 |
| 5,695,065 | A | * | 12/1997 | Kennedy et al. | 206/554 |
| 5,697,576 | A | * | 12/1997 | Bloch et al. | 242/596.8 |
| 5,950,818 | A | | 9/1999 | Paulsen | |
| 5,957,325 | A | * | 9/1999 | Montanez | 221/131 |
| 5,979,821 | A | * | 11/1999 | LaCount et al. | 242/560.1 |
| D420,590 | S | | 2/2000 | Gobe | |
| 6,059,100 | A | | 5/2000 | Jones | |
| 6,092,759 | A | * | 7/2000 | Gemmell et al. | 242/596.8 |
| 6,131,764 | A | * | 10/2000 | Norman | 221/45 |
| D470,991 | S | | 2/2003 | Goldstein | |
| 6,557,723 | B2 | * | 5/2003 | Chen | 221/45 |
| D494,852 | S | | 8/2004 | Meador et al. | |
| 6,779,683 | B2 | * | 8/2004 | Taylor et al. | 221/61 |
| 6,785,946 | B2 | * | 9/2004 | Romme et al. | 29/407.01 |
| 6,920,999 | B2 | * | 7/2005 | Taylor et al. | 221/154 |
| 7,624,881 | B2 | * | 12/2009 | Wilfong, Jr. | 211/59.2 |
| 2006/0219733 | A1 | * | 10/2006 | Gardner et al. | 221/309 |

OTHER PUBLICATIONS

Notice of Allowance for Design U.S. Appl. No. 29/288,501.

* cited by examiner

DISPENSER

CROSS-REFERENCE TO RELATED APPLICATIONS

This application is a continuation-in-part of U.S. Design Pat. Application No. 29/303,832, filed on Feb. 19, 2008, and a continuation-in-part of application Ser. No. 11/470,956, filed on Sep. 7, 2006, which claims the benefit of U.S. Provisional Application No. 60/715,218, filed on Sep. 7, 2005, and U.S. Provisional Application No. 60/730,588, filed Oct. 26, 2005, all of which are hereby incorporated by reference herein for all purposes.

BACKGROUND

The invention relates to dispensing apparatuses and particularly to dispensers of bags or other sheet-like materials.

In the dispensing of substantially flat, stacked, plastic bags, it is difficult to arrange the stack so that they are substantially upright, dispensing readily downward via the application of a finger contacting the surface of the topmost bag and drawing the topmost bag from the dispenser in a downward motion of the contacting finger. Further the quick assembly of such a dispenser and readily replacement of the stacked, plastic bags within an assembled dispenser can conflict with feeding from replacement stack in that folds or bags out of sort may jam the mechanical dispensability of the stack.

There remains a need for a dispenser for dispensing individually from a stack of plastic bags contained therein where such dispenser provides for ready replacement of stacks of plastic bags and the dispensing mechanism provides for the ready withdrawal of an individual bag via the motion of a finger.

SUMMARY OF THE INVENTION

The invention includes several embodiments of a dispenser as an article of manufacture. For example, a dispenser embodiment may comprise a first member having a first, second and third panel, the second panel having an upper and lower panel separated by a lineal aperture comprising an arcuate aperture of the upper panel that rotates. A first member engages the second member, defining a cavity which further comprises a sheet-guiding member extending at an inclined angle into the cavity. The second member further comprises at least one sheet-guiding member extending at an angle inclined into the cavity which may be resilient and inclined out of the plane of the at least one sheet-guiding member extending from the second member.

BRIEF DESCRIPTION OF THE DRAWINGS

Embodiments of the present invention are illustrated by way of example and not limitation in the figures of the accompanying drawings, and in which.

DETAILED DESCRIPTION OF THE INVENTION

Figure 1A:
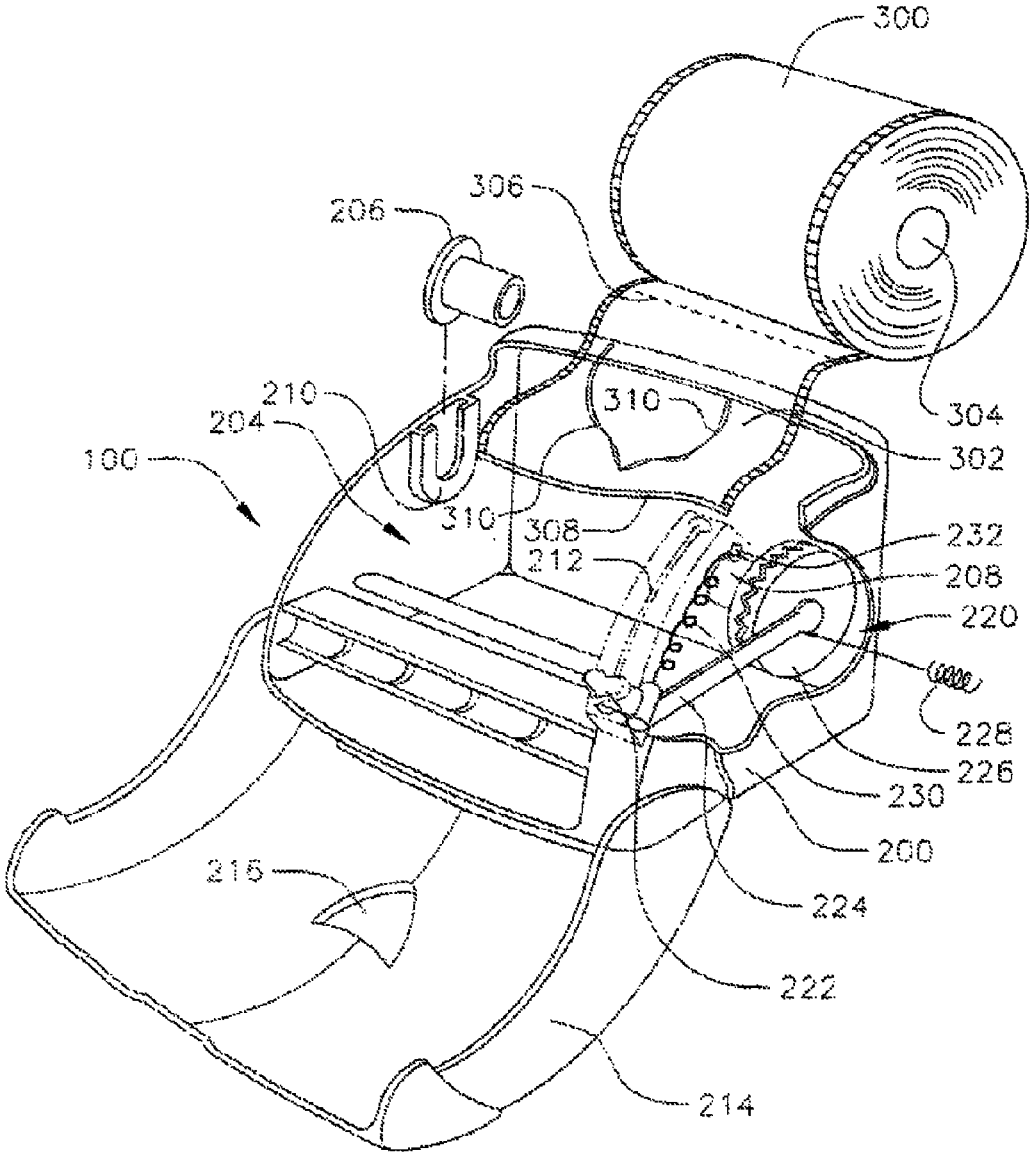
FIG. 1*a* is a partial cut-out and exploded perspective view of one embodiment of a system for disposal according to the invention.
Figure 1B:
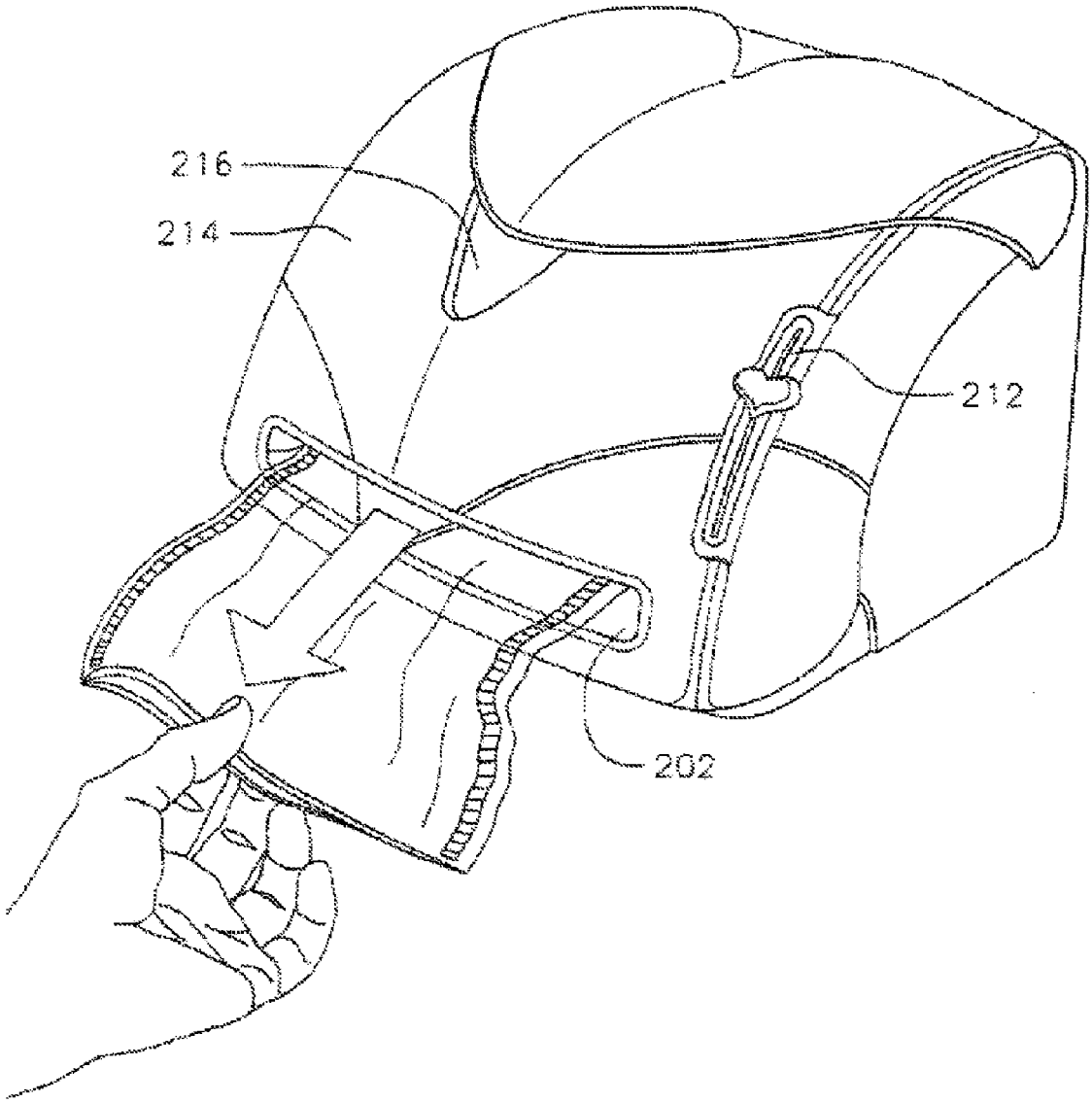
FIG. 1*b* is a front perspective view of the embodiment shown in FIG. 1*a* in a closed position.

As can be seen in FIGS. 1*a* and 1*b*, a system for disposal of feminine hygiene products 100 includes a dispenser 200 with a dispensing opening 202 and an inner cavity 204. The dispenser 200 also includes a slit 212 and a viewing window 216 in its hinged, front face 214.

A roll 300 of bags 302 with a central opening 304 is disposed within the inner cavity 204. The central opening 304 of the roll of bags 300 engages with protrusions 206, 208 on opposite lateral sides of the inner cavity 204. One protrusion 206 rotates freely within a groove 210 fixed on the dispenser 200. The other protrusion 208 extends from a latch mechanism 220 and engages with force locking engagement with the central opening 304 of the roll 300.

The latch mechanism 220 in this embodiment includes a handle 222 that extends through the slit 212 in the front face 214 of the dispenser 200. The handle 222 is rigidly connected to an arm 224 fixed to a rotatable, toothed catch gear 226. A compression spring 228 is disposed between the arm 224 and the catch gear 226 to push the teeth of the catch gear 226 into engagement with the teeth of the protrusion 208. A tension spring 232 couples the distal end of the arm 224 to the protrusion 208 to pull the handle 222 upward.

Figure 1C:
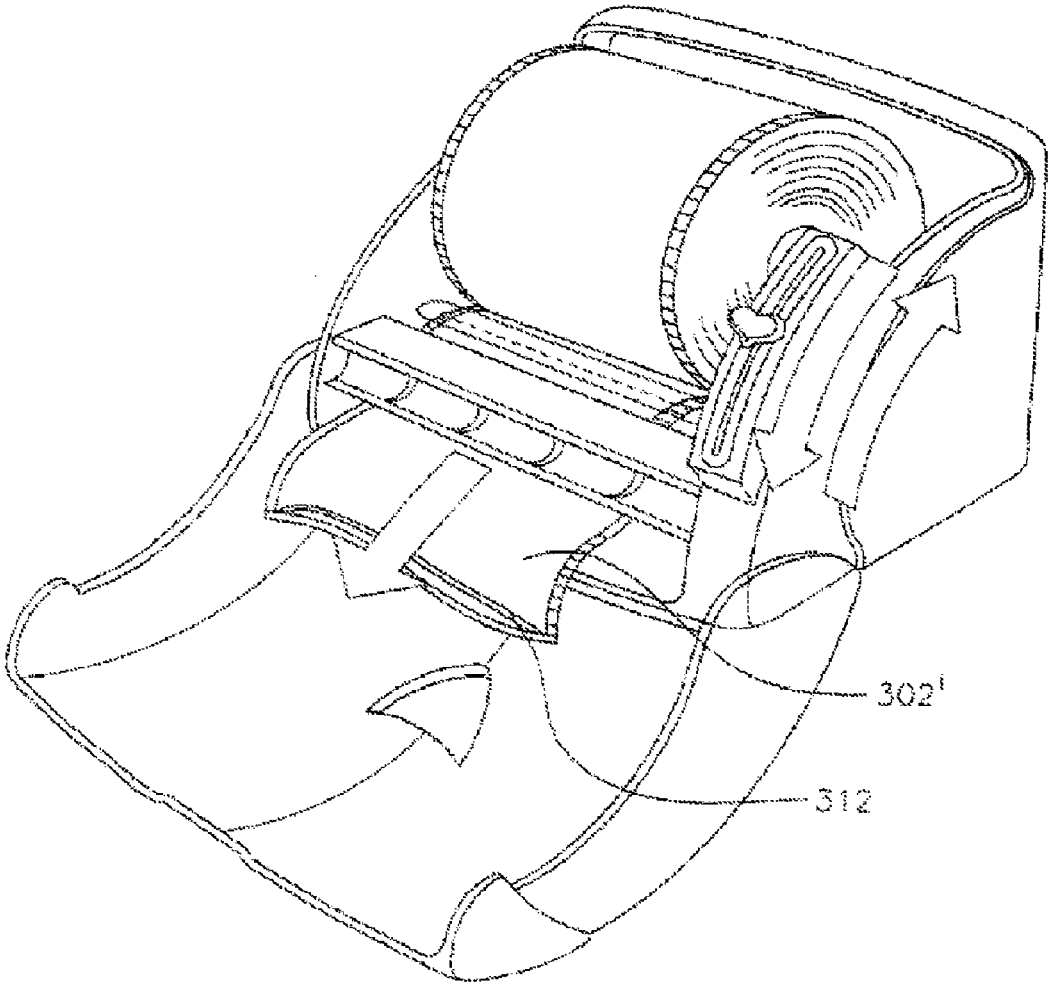
FIG. 1*c* is a front perspective view of the dispenser shown in FIGS. 1*a* and 1*b* in an open position with an alternate embodiment of a bag according to the invention.

As shown in FIGS. 1*a*-1*c*, as the handle 222 is pulled against the force of the tension spring 230 toward the bottom of the slit 212, the arm 224 rotates the catch gear 226 so that it is not in toothed engagement with the protrusion 208. As the handle 222 is brought back up due to the force of the tension spring 230, however, the teeth of the catch gear 226 engage with the teeth of the protrusion 208 to rotate the protrusion 208. The roll 300 is thus rotated through force-locking engagement with the protrusion 208, whereby a single is bag 302 is dispensed through the dispensing opening 202, and can be grasped and detached from the roll 300 by tearing its perforations 306.

The bag 302 shown in FIG. 1*a* has a closeable portion 310 adjacent to the opening 308 of the bag 302. One closeable portion includes at least two tiable elements 310, which, after a soiled feminine hygiene product is placed within the bag 302, the tiable elements 310 are tied tightly together to close the opening 308 of the bag 302.

Alternatively, as shown in FIG. 1*c*, a bag 302' may have a closeable portion 312 that includes a groove portion and a projecting portion facing the groove portion and interlockable with the groove portion, such as a Zip-Lock™-type closure.

Figure 2A:
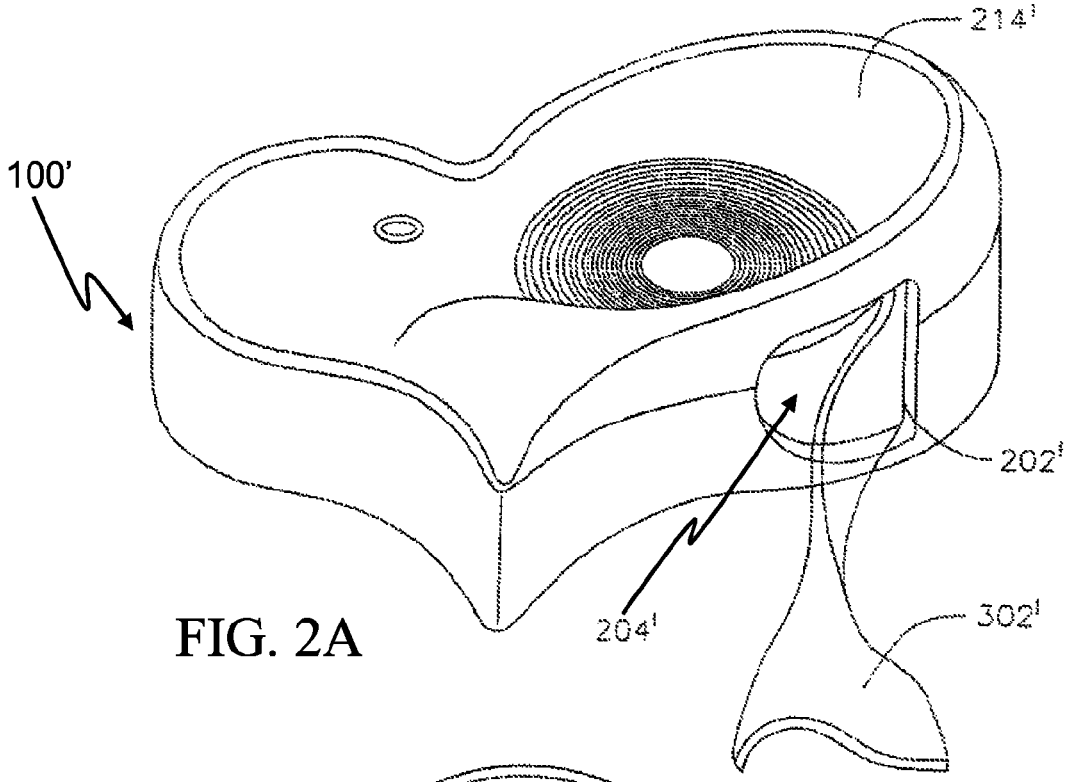
FIG. 2*a* is a bottom perspective view of another embodiment of a system for disposal according to the invention.
Figure 2C:
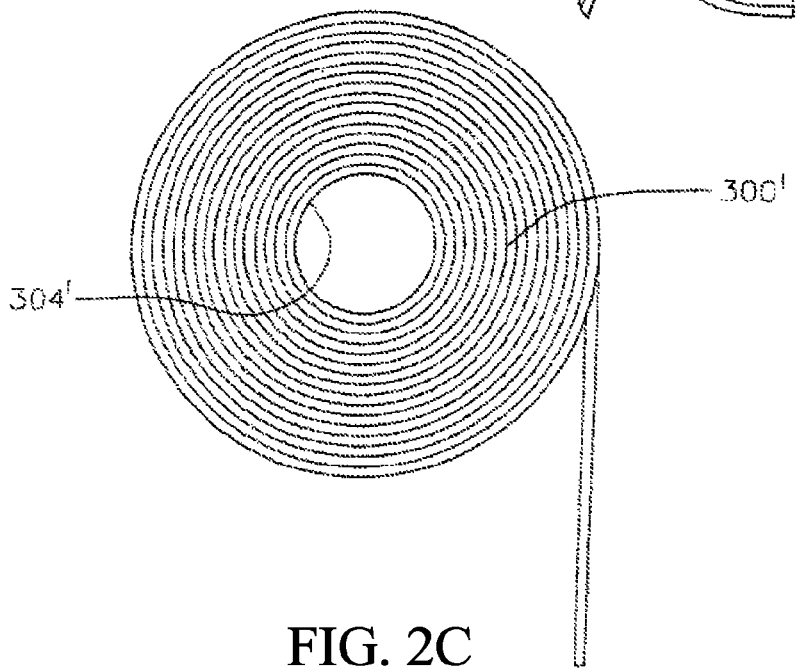
FIG. 2*c* is a side perspective view of a roll of bags according to one embodiment of the invention.
Figure 2B:
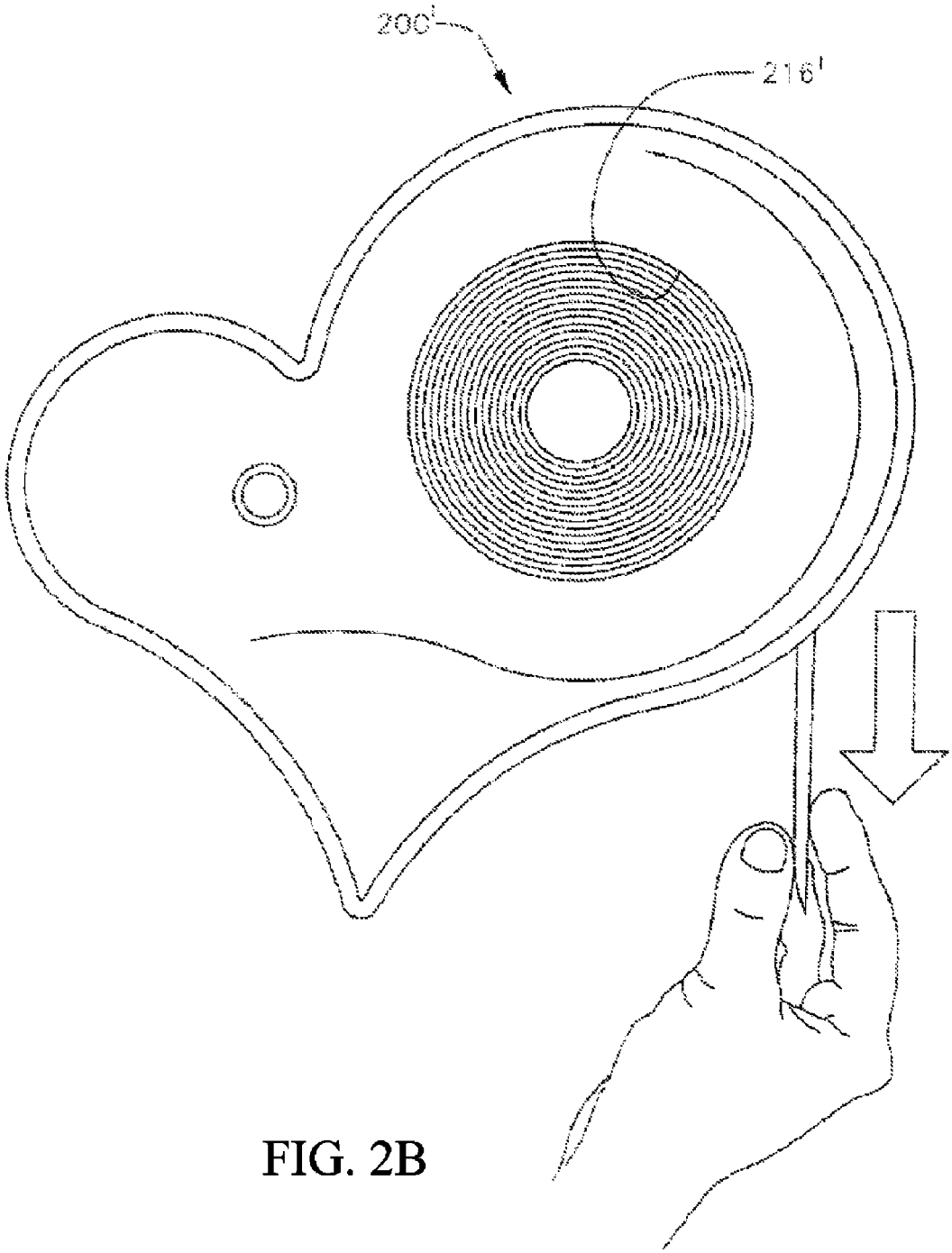
FIG. 2*b* is a front perspective view of the embodiment shown in FIG. 2*a;*

As shown in FIGS. 2*a*-2*c*, another embodiment of a system for disposal of feminine hygiene products 100' includes a dispenser 200' with a dispensing opening 202' and an inner cavity 204'. The dispenser 200' also includes a viewing window 216' in its front face 214'.

A roll 300' of folded bags 302' is disposed within the inner cavity 204'. A folded bag 302' extending out of the dispensing opening 202' can be grasped, pulled, and its perforations connecting it with the other bags can be torn. In this embodiment, the roll 300' of bags 302' sits and can rotate freely within a substantially cylindrically shaped portion of the inner cavity 204'. However, it is also within the scope of the invention to provide one or more protrusions in the inner cavity 204' to engage the central opening 304' of the roll 300'.

Figure 3:
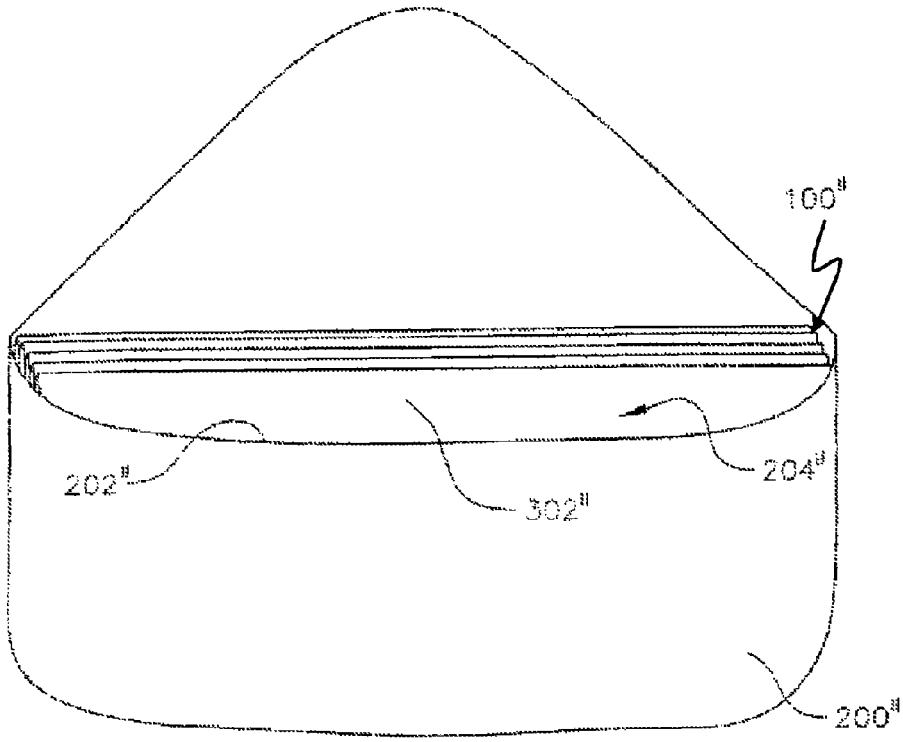
FIG. 3 is a front perspective view of another embodiment of a system for disposal according to the invention.

FIG. 3 depicts yet another embodiment of a system for disposal of feminine hygiene products 100" including a dispenser 200" with a dispensing opening 202" and an inner cavity 204". The dispenser 200" is in the shape of a bag and is in a size convenient for carrying in a pocket or a purse.

Folded bags 302" are disposed within the inner cavity 204" of the dispenser 200". Each folded bag 302" may be grasped individually from the dispenser 200" and used.

Figure 7:
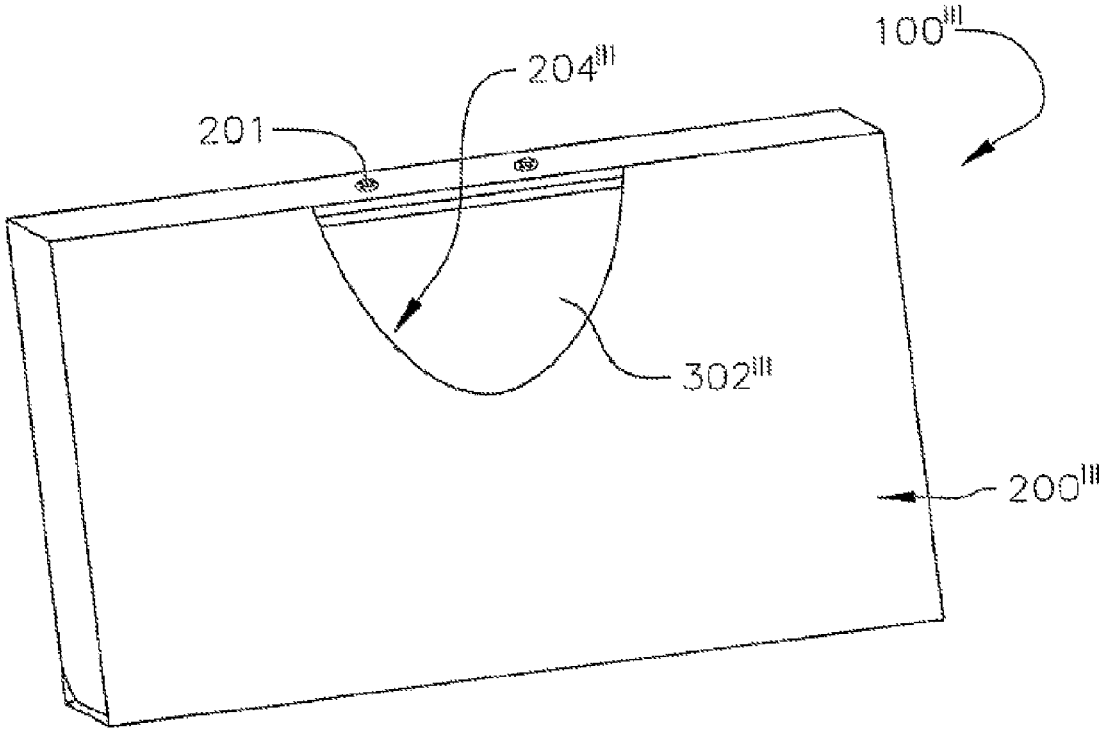
FIG. 7 is a front perspective view of another embodiment of a system for disposal according to the invention.

As shown in FIG. 7, the disposal system 100''' may include a dispenser 200''' in the form of a mountable housing with screw holes 201. The dispenser 200'''includes folded bags 302''', similar to those described above, within its inner cavity 204'''.

Figure 8:
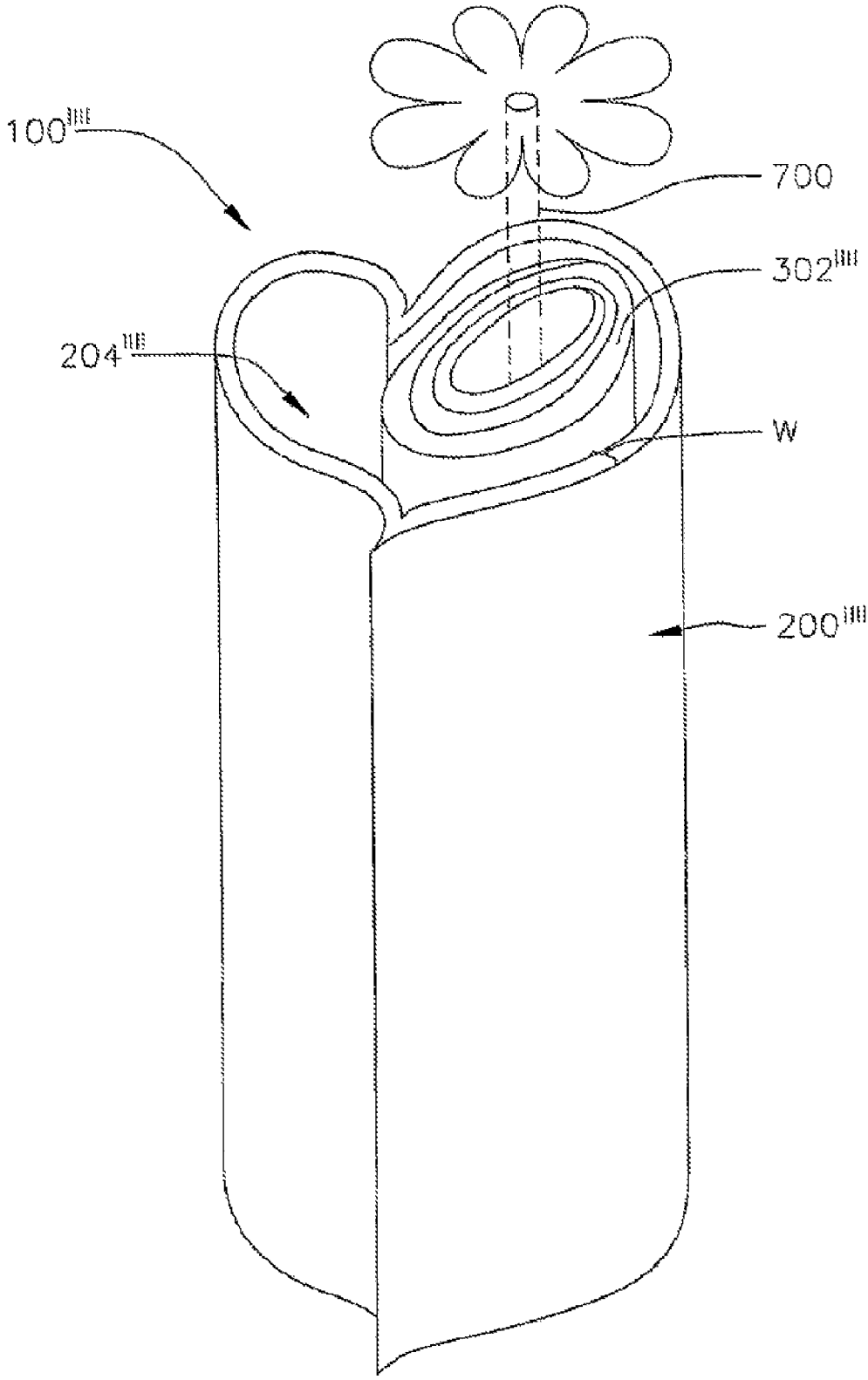
FIG. 8 is a perspective view of yet another embodiment of a system for disposal according to the invention.
Figure 9:
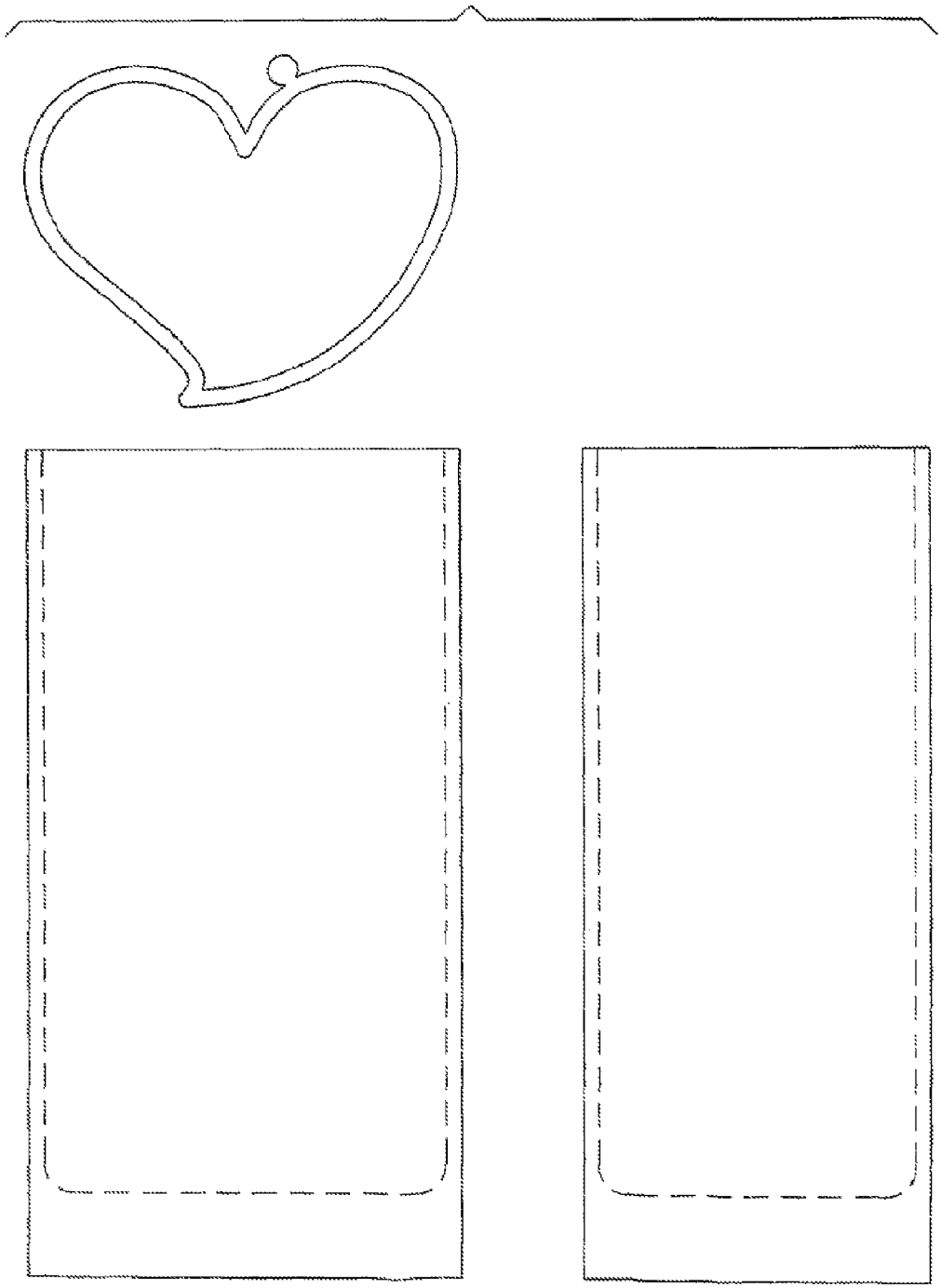
FIG. 9 shows a plan view and a side perspective view of the embodiment shown in FIG. 8.

As shown in FIG. 8, the disposal system 100'''' may include a dispenser 200'''' in the form of a vase. In this embodiment, the shape of the vase from a top view is in the shape of the heart, but the invention is not limited thereto. A roll of bags 302'''' is located within the inner cavity 204''''. A silk flower 700 is also included in this embodiment, and fits within an opening in the roll of bags 302''''. In this embodiment, the vase has a width w of the side wall of approximately 0.125 inch, an approximately 0.250 inch inner radius, and an approximate height of 7 inches. However, the invention is not limited thereto.

Figure 4:
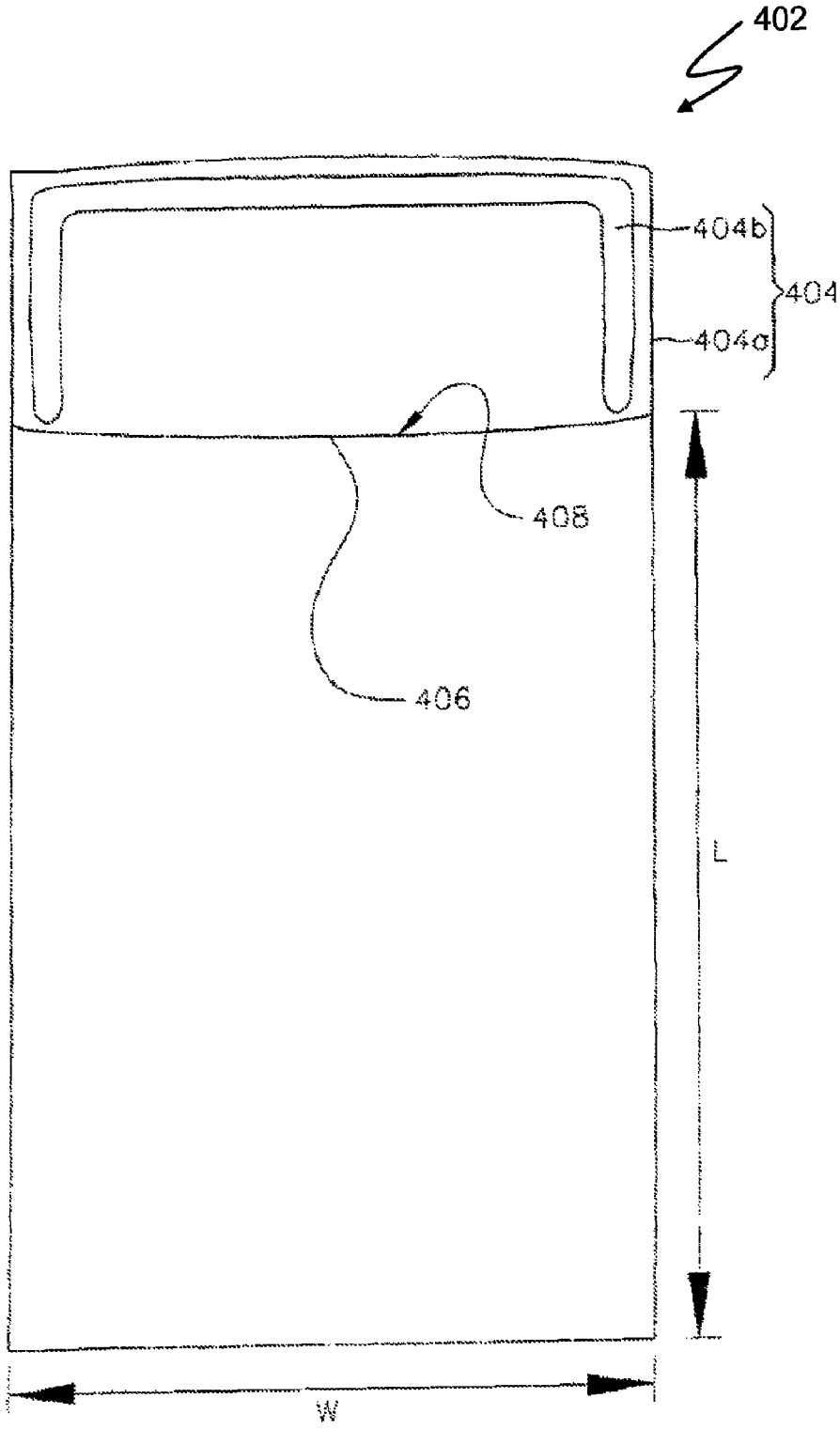
FIG. 4 is a front perspective view of one embodiment of a bag according to the invention.

Another embodiment of a bag 402 is shown in more detail in FIG. 4. The bag 402 includes a closeable portion 404 for enclosing a feminine hygiene product within the bag. In this embodiment, the closeable portion 404 includes a flap 404*a* with an adhesive strip 404*b* extending beyond an edge 406 of the bag opening 408. The adhesive strip 404*b* in this embodiment extends around the periphery of the flap 404*a*, but it is also within the scope of the invention for the strip to only extend in one direction on the flap. The adhesive strip 404*b* may be covered by release paper until ready to use. When the flap 404*a* is folded over the bag opening 406, the adhesive 404*b* adheres to the edge 406 to create a liquid-proof seal.

In this embodiment, the bag 402 is opaque and scented. These features can reduce possible embarrassment if the bag must be set in an open receptacle or carried in a purse or through a public place to be disposed of in an off-site receptacle. The bag 402 in this embodiment is made from a biodegradable material, such as low density polyethylene (LDPE) with a biodegradable additive, such as an oxo-biodegradable additive available from EPI™ called TDPA.

The length L of the bag is approximately three to ten inches, and its width W is approximately two to eight inches. In this embodiment, the length L is eight inches and the width W is six inches. The flap 404 extends approximately one inch from the edge 406. However, one skilled in the art will understand that the length, width, and extension of the flap may be modified to securely contain any size sanitary napkin or tampon. The thickness of each of the walls of the bag 402 is approximately 0.025 mm to 0.15 mm. The thickness may be varied according to the material of the bag so that the bag is sufficiently strong to resist tears or leaks during its use.

Figure 5A:
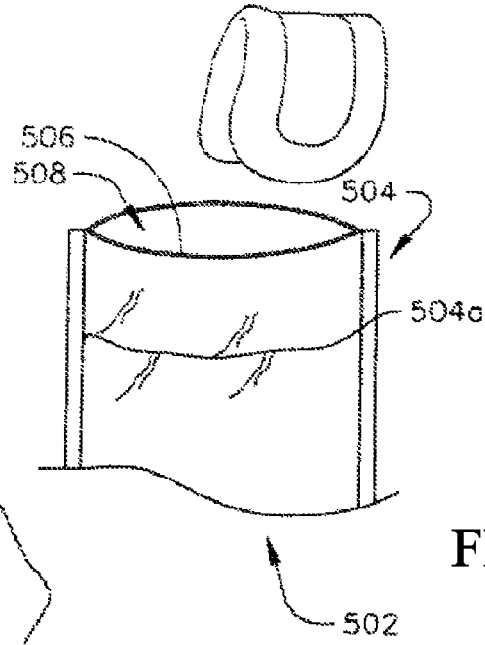
FIG. 5*a* is a front perspective view of another embodiment of a bag according to the invention.
Figure 5B:
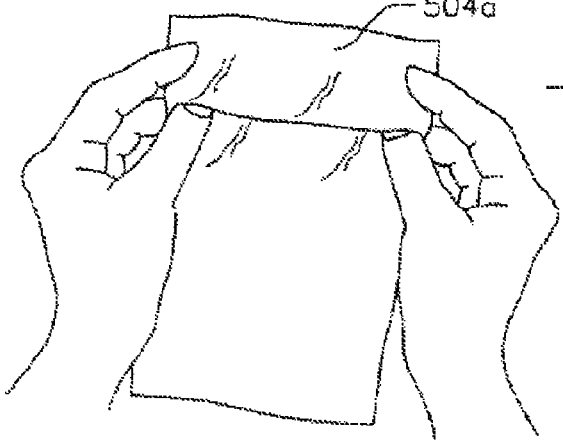
FIG. 5*b* is a front perspective view of the bag shown in FIG. 5*a* in a first stage of being closed.
Figure 5C:
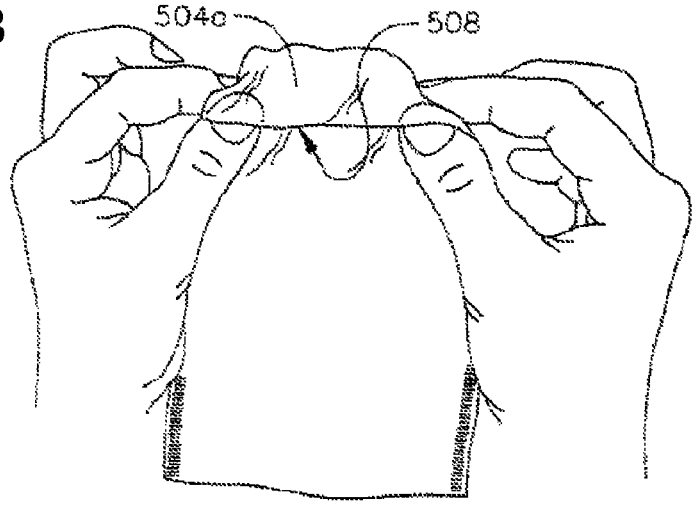
FIG. 5*c* is a front perspective view of the bag shown in FIGS. 5*a* and 5*b* in a second stage of being closed.

FIGS. 5*a*-5*c* show a third embodiment of a bag 502 according to the invention. The bag 502 includes a closeable portion 504 with an outer pocket 504*a* opening downward and fixed to a rear side of the bag 502. The non-opening side of the outer pocket 504*a* forms an edge 506 of the opening 508 of the bag 502.

Figure 5D:
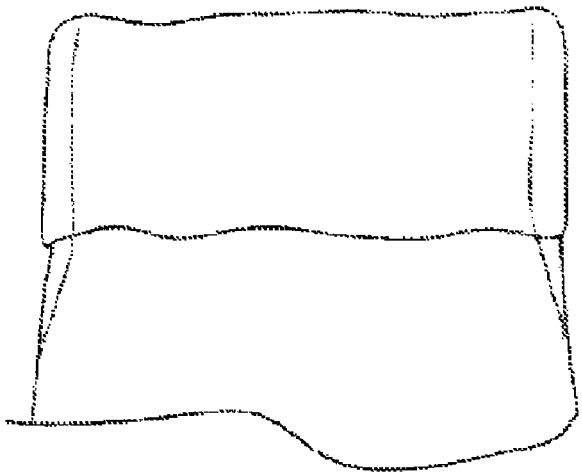
FIG. 5*d* is a rear perspective view of the bag shown in FIGS. 5*a*-5*c* in a closed position.

To close the opening 508 of the bag 502, a user slides his or her fingers into the opening of the outer pocket 504*a* after a soiled feminine hygiene product has been placed inside the bag 502 as shown in the front view of FIG. 5*b*. The outer pocket 504*a* is then folded inside out over the opening 508 of the bag 502, as shown in the front view of FIG. 5*c* and the rear view of FIG. 5*d*. Adhesive may also be added to the folded edge of the outer pocket 504*a* so that, when folded inside out, the outer pocket 504*a* adheres to the front of the bag 502 to seal the opening 508.

Figure 5E:
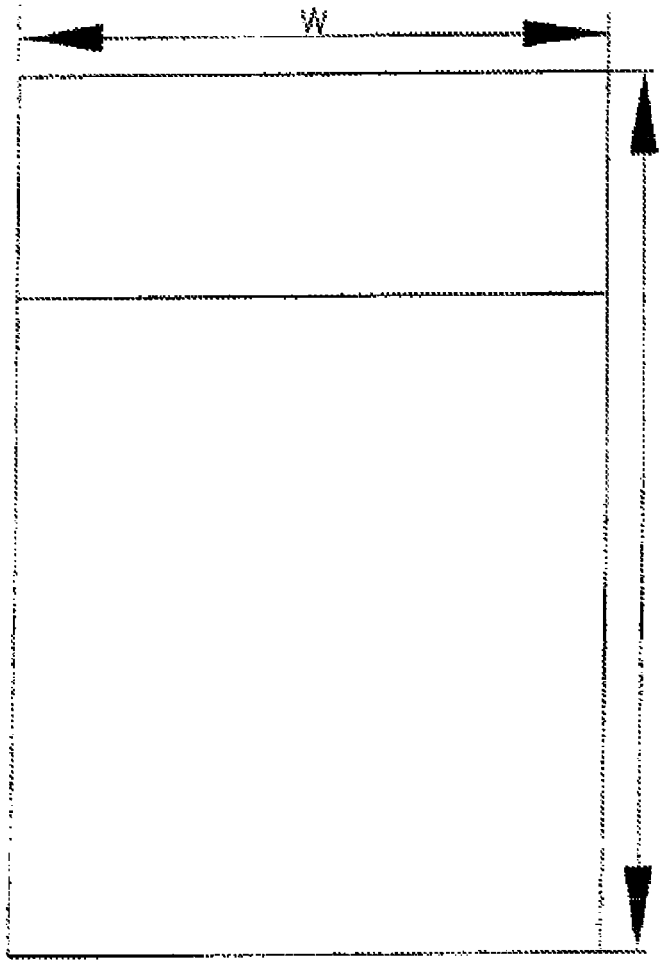
FIG. 5*e* is a front perspective view of the bag shown in FIGS. 5*a*-5*d;*

As shown in FIG. 5*e*, the bag 502 has a length L of approximately six inches and a width W of approximately four inches. The outer pocket 504*a* is approximately one inch deep.

Figure 6:
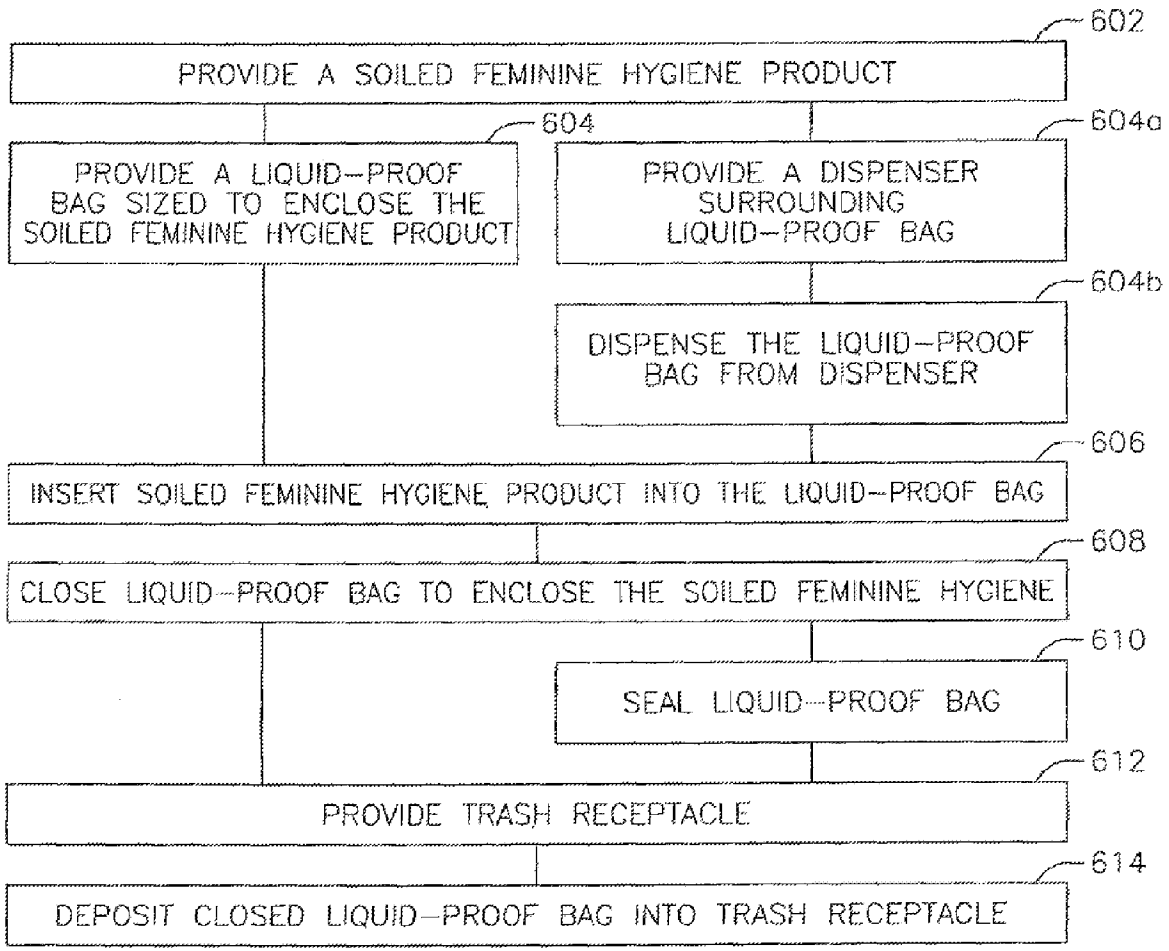
FIG. 6 is a schematic diagram of one embodiment of a method according to the invention.

A method of protecting against contamination from a feminine hygiene product is shown in FIG. 6. The method includes providing a soiled feminine hygiene product 602 and a liquid-proof bag 604 sized to enclose the soiled feminine hygiene product. Providing the liquid-proof bag 604 may include providing a dispenser surrounding the bag 604*a* and dispensing the bag from the dispenser 604*b*. The soiled feminine hygiene product is inserted into the bag 606. The bag is then closed 608 and, in one embodiment, sealed 610 to enclose the soiled feminine hygiene product inside the bag. A trash receptacle can also be provided 612 and the closed bag may be deposited into the trash receptacle 614.

Figure 10A:
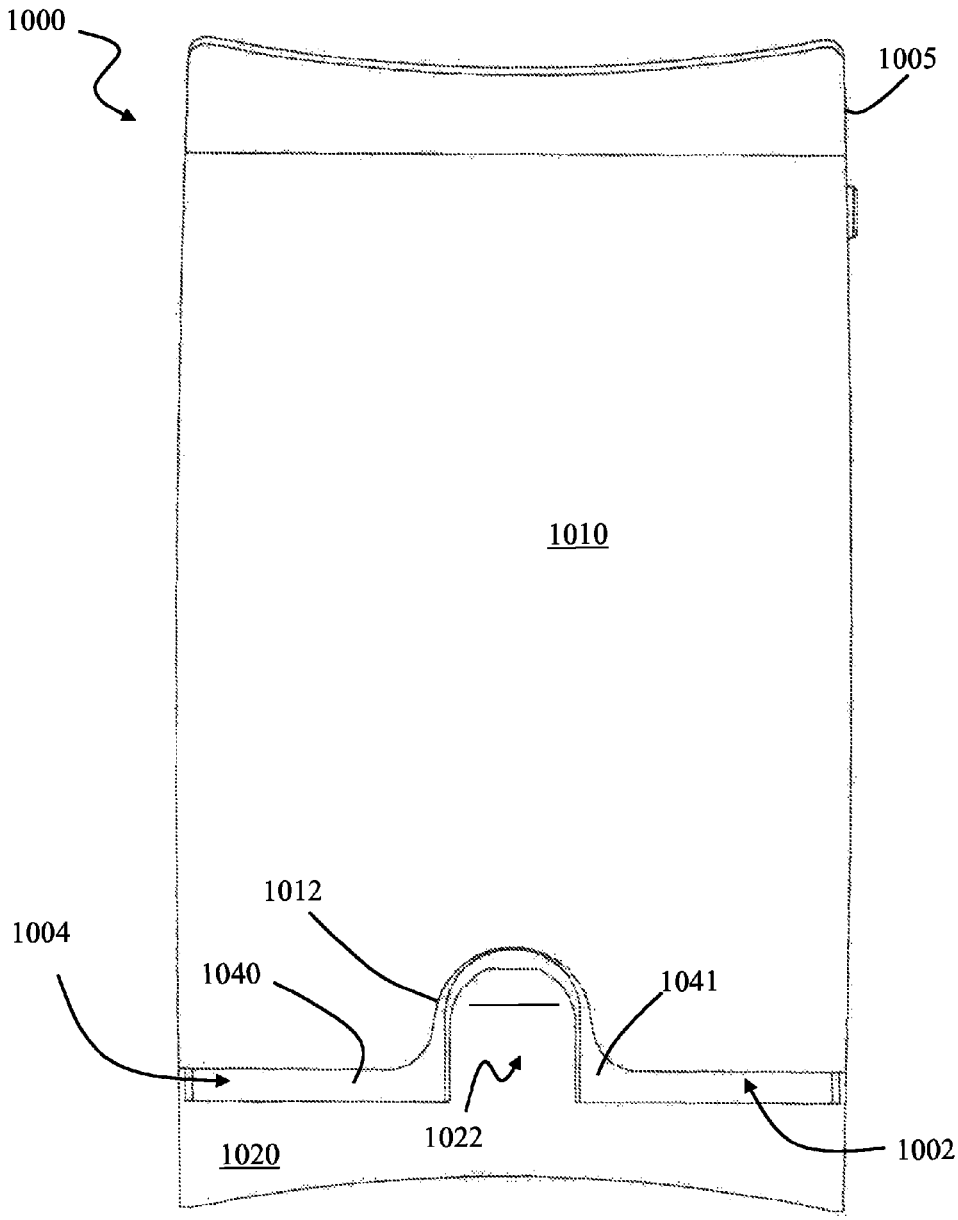
FIG. 10*a* is a front view of a dispenser embodiment of the present invention.

FIG. 10*a* is a front view of a dispenser embodiment 1000 of the present invention comprised, in this example, of two plastic moldings, i.e., a back panel molding 1005 and a front panel molding 1010, that together define a bag storage cavity 1002 and an outlet slot, such as a lineal slot 1004, where an upper front panel 1010 is shown having an arcuate cut-out region 1012. While the example of FIG. 10*a* may be a product of a molding, the term "arcuate cut-out" is used herein to describe the arch-like aperture of the front panel 1010. Extending from the lower front panel 1020 of the front panel molding 1010 toward the upper front panel is a resilient tongue portion 1022 of the lower front panel and the tongue portion 1022 is inclined into the main cavity of the dispenser

Figure 10B:
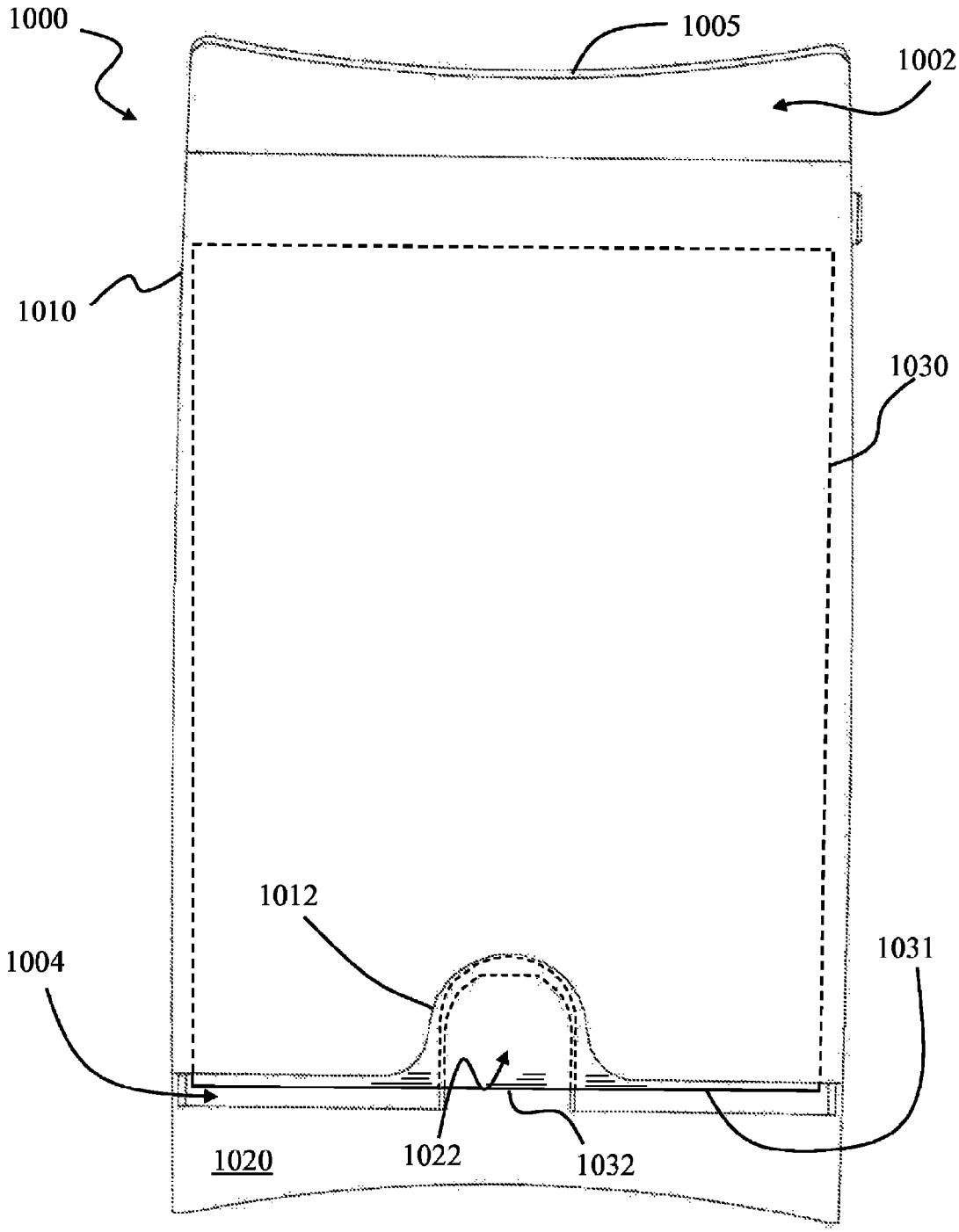
FIG. 10*b* is a front view of a partially loaded dispenser embodiment of the present invention.
Figure 11:
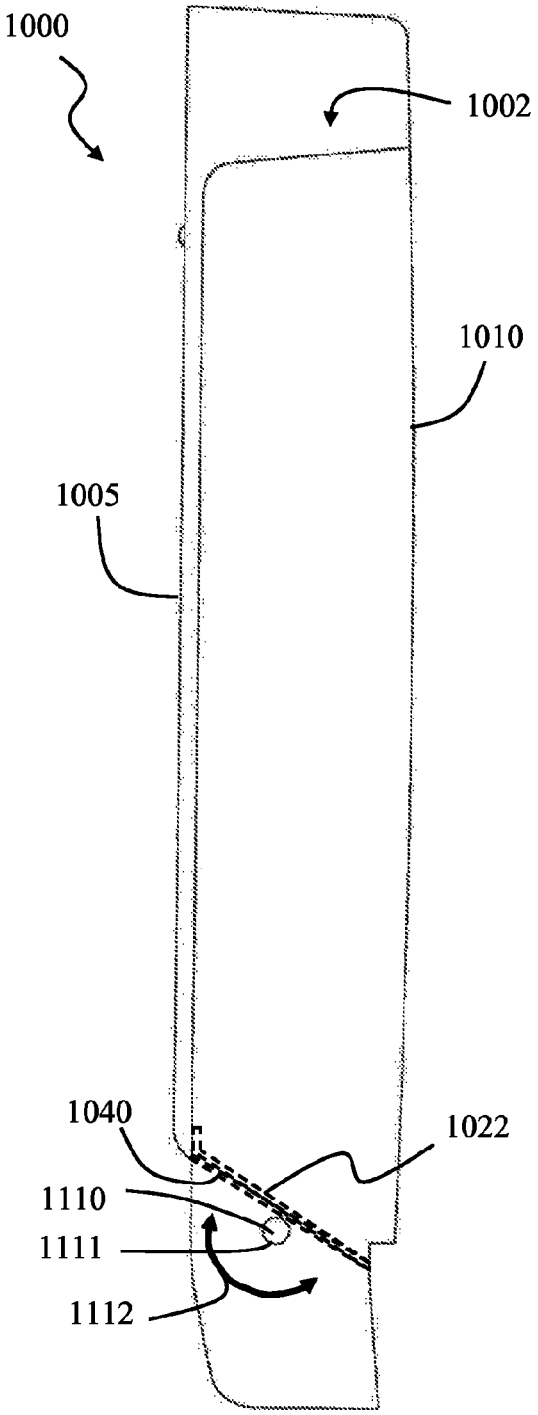
FIG. 11 is a view of the right side of the dispenser embodiment of FIG. 10 of the present invention.
Figure 12:
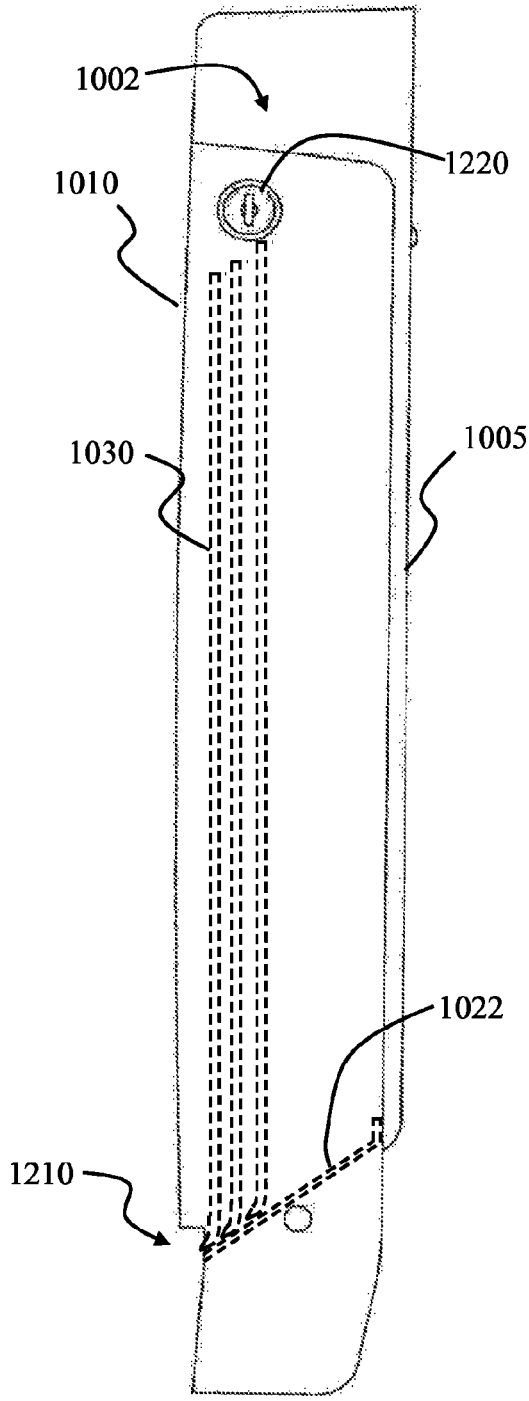
FIG. 12 is a view of the left side of the dispenser embodiment of FIG. 10 of the present invention.
Figure 13:
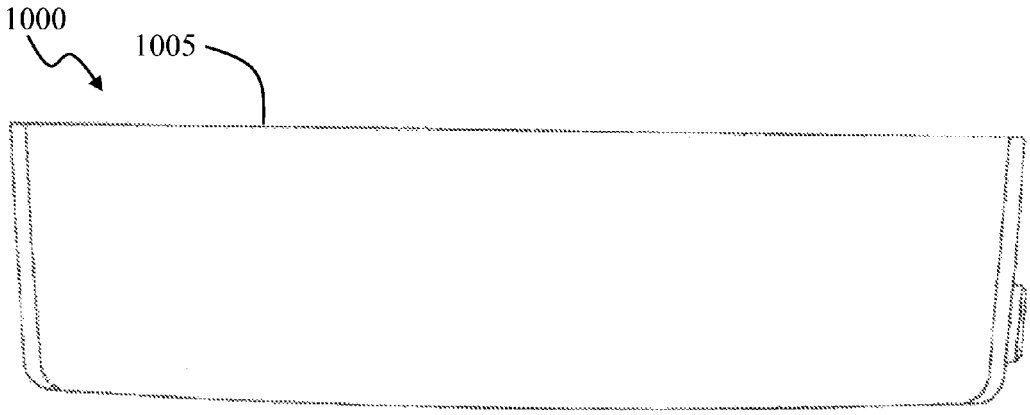
FIG. 13 is a view of the top of the dispenser embodiment of FIG. 10 of the present invention.
Figure 14:
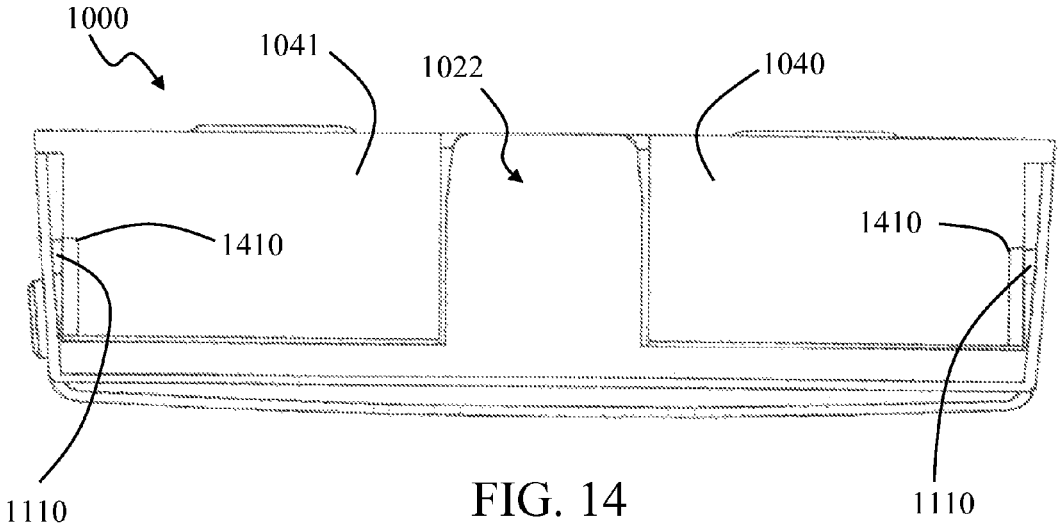
FIG. 14 is a view of the bottom of the dispenser embodiment of FIG. 10 of the present invention.
Figure 15:
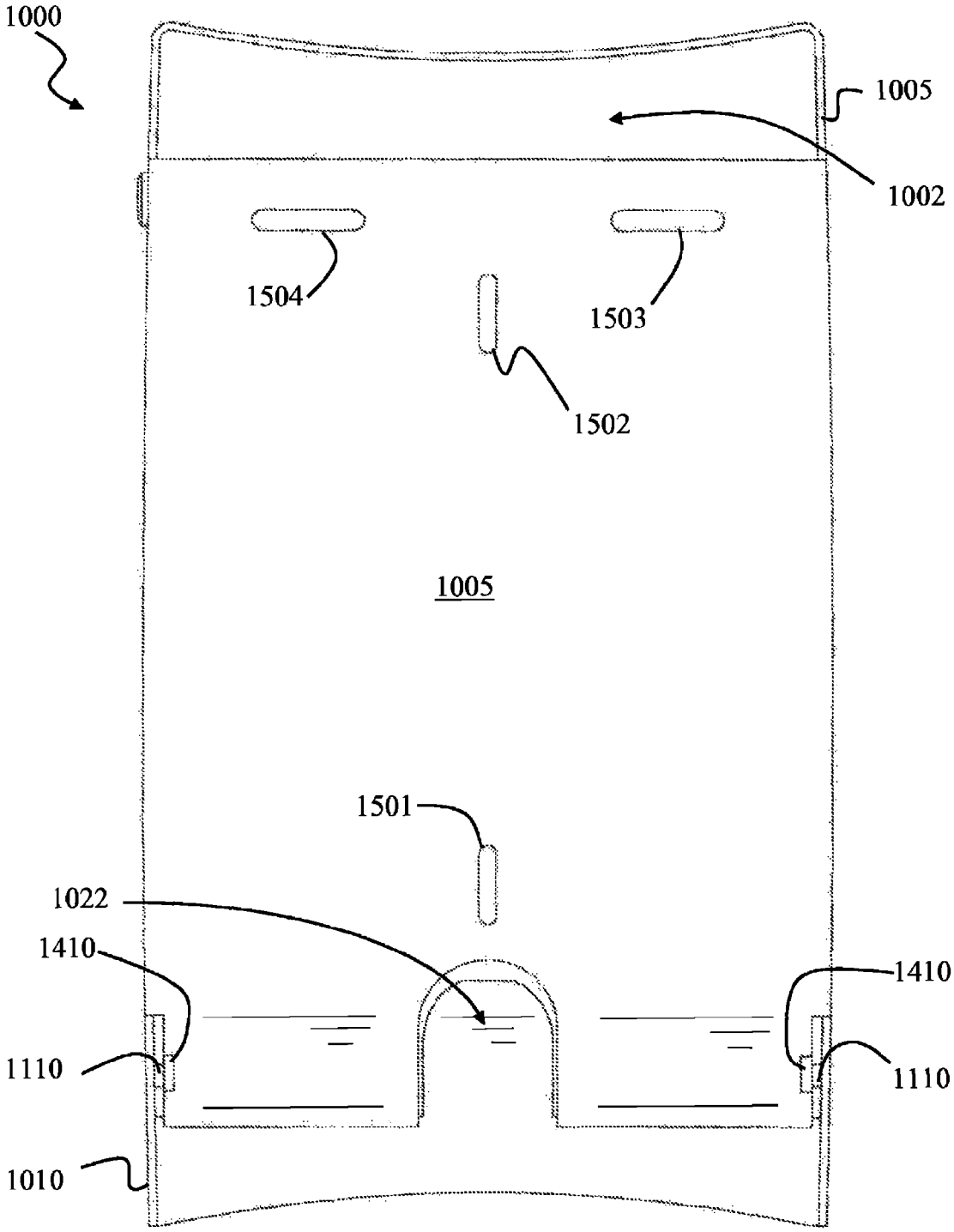
FIG. 15 is a back view of a dispenser embodiment of the present invention.

1000. FIG. 10*b* is a front view of a dispenser embodiment 1000 of the present invention where a substantially flat bag 1030 having a rectangular planform is shown within the bag storage cavity 1002 with a portion of the bag 1031 visible at the outlet slot 1004 and visible at the arcuate cut-out 1012 as a portion of the bag 1032 rests on a portion of the resilient tongue 1022. FIG. 11 shows a right side view of the exemplary dispenser 1000 and also the resilient tongue 1022 inclined into the bag storage cavity 1002. In the side view of FIG. 11, the resilient tongue portion 1022 is above a rotation pin 1110 that may extend from a portion back panel into an aperture 1111 of the front panel 1010. Accordingly, the exemplary dispenser 1000 may be articulated so that the front panel molding 1010 may rotate 1112 about the axis of the pin 1110 relative to the back panel molding 1005. Accordingly, edges of bags may rest across the bag-guiding members 1040, 1041 and drawn by gravity and the loading effect of the tongue; the bags are presented at the lineal aperture 1004. A user may draw the bag placing a finger through the arcuate aperture via a drawing-down motion extract the bag. FIG. 12 shows a left side view of the exemplary dispenser 1000 and also the resilient tongue 1022 inclined into the bag storage cavity 1002. In the side view of FIG. 12, a plurality of substantially flat bags 1030 are shown within the bag storage cavity 1002, where a portion of each bag 1210 rests on the resilient tongue portion 1022. The exemplary dispenser 1000 may also include a locking mechanism 1220 that both joins the front panel 1010 to back panel molding 1005. FIG. 13 is a top planview of the exemplary dispenser 1000 where the back panel molding 1005 provides for a flush mounting onto a flat surface. FIG. 14 is a bottom plan view of the exemplary dispenser 1000 showing the rotation pins 1110 each extending from a structural member 1410 where each structural member 1410 is integral with, or fixed to, the back panel molding 1005. FIG. 15 is a view of the back side of the exemplary dispenser 1000 that also shows the rotation pins 1110 each extending from a structural member 1410 where each structural member 1410 is integral with, or fixed to, the back panel molding 1005. The back panel molding 1005 may also include apertures for surface mounting 1501-1504 the exemplary dispenser 1000.

Alterations, modifications and variations may be made by those having ordinary skill in the art without departing from the spirit and scope of the invention. Therefore, it must be understood that the illustrated embodiments have been set forth only for the purposes of example and as such should not be taken as limiting the invention as defined by the following claims.

What is claimed is:

1. A dispenser comprising:

a first member comprising a first panel interposed between a second panel and a third panel, the second panel and third panel both extending in the same direction perpendicularly from the first panel; the first panel comprising an upper panel and a lower panel separated by a lineal aperture, the lineal aperture comprising an arcuate aperture of the upper panel;

the first member rotatably attached to a second member;

wherein the first member engages the second member defining a substantially cuboid cavity;

wherein the first member further comprises a sheet-guiding member extending at an angle inclined from the lower panel into the cuboid cavity and configured to retain a plurality of stacked sheets for dispensing; and wherein the second member further comprises at least one sheet-guiding member extending at an angle declined from a portion of the second member proximate to the lineal aperture of the first panel of the first member, wherein the at least one sheet-guiding member of the second member extends into the substantially cuboid cavity and is configured to support the plurality of stacked sheets substantially edge-on in cooperation with the sheet-guiding member extending from the first member and is further configured to conduct a leading edge of a sheet of the plurality of stacked sheets outward from the cuboid cavity wherein the sheet-guiding member extending from the lower panel comprises a resilient tongue configured via resilient loading to present the sheet of the plurality of stacked sheets at the aperture.

2. The dispenser of claim 1 wherein the sheet-guiding member extending from the lower panel is inclined out of the plane of the at least one sheet-guiding member extending from the second member.

3. A dispenser comprising:

a first member comprising a first panel interposed between a second panel and a third panel, the second panel and third panel both extending in the same direction perpendicularly from the first panel; the first panel comprising an upper panel and a lower panel separated by a lineal aperture, the lineal aperture comprising an arcuate aperture of the upper panel;

the first member rotatably attached to a second member;

wherein the first member engages the second member defining a cavity boxing a plurality of stacked flat bags;

wherein the first member further comprises a flat-bag-guiding member extending at an angle inclined from the lower panel into the cavity; and wherein the second member further comprises at least one sheet-guiding member extending at an angle declined from a portion of the second member proximate to the lineal aperture of the first panel of the first member, wherein the sheet-guiding member of the second member extends into the cavity and is configured to conduct a leading edge of a flat bag of the plurality of stacked flat bags outward from the cavity wherein the flat-bag-guiding member extending from the lower panel comprises a resilient tongue configured via resilient loading to present the flat bag of the plurality of stacked flat bags at the aperture.

4. The dispenser of claim 3 wherein the flat-bag-guiding member extending from the lower panel is inclined out of the plane of the at least one sheet-guiding member extending from the second member.

* * * * *